US010253570B2

(12) United States Patent
Ihlein et al.

(10) Patent No.: US 10,253,570 B2
(45) Date of Patent: Apr. 9, 2019

(54) EXTENDABLE DRILLING TOOL

(71) Applicant: DRILLSTAR INDUSTRIES, Lons (FR)

(72) Inventors: Patrick Ihlein, Poey de Lescar (FR); Raphael Souchal, Lons (FR); Jean-Aime Boutelier, Lourdes (FR); Cedric Cabe, Assat (FR)

(73) Assignee: DRILLSTAR INDUSTRY, Lons (FR)

( * ) Notice: Subject to any disclaimer, the term of this patent is extended or adjusted under 35 U.S.C. 154(b) by 688 days.

(21) Appl. No.: 14/740,788

(22) Filed: Jun. 16, 2015

(65) Prior Publication Data

US 2015/0361726 A1 Dec. 17, 2015

(30) Foreign Application Priority Data

Jun. 16, 2014 (FR) ..... 14 55481

(51) Int. Cl.
*E21B 10/32* (2006.01)
*E21B 7/28* (2006.01)

(52) U.S. Cl.
CPC ..... *E21B 10/32* (2013.01); *E21B 7/28* (2013.01); *E21B 10/322* (2013.01)

(58) Field of Classification Search
CPC ..... E21B 10/32; E21B 10/322; E21B 10/325; E21B 7/28
See application file for complete search history.

(56) References Cited

U.S. PATENT DOCUMENTS 1,485,642 A 3/1924 Frederick
1,878,260 A 9/1932 Bunker
2,427,052 A * 9/1947 Grant ..... E21B 10/322 175/269
5,014,780 A * 5/1991 Skipper ..... E21B 10/322 166/55.8
6,615,933 B1 9/2003 Eddison
6,732,817 B2 5/2004 Dewey et al.
7,401,666 B2 7/2008 Fanuel et al.
2012/0080183 A1 4/2012 Radford et al.
2013/0168076 A1 7/2013 Davis

OTHER PUBLICATIONS

BakerHughes—Drillable Products—N-1 Bridge Plug—H40120-1 [https://assets.shopbakerhughes.com/pdf/H40120-1.pdf] (Year: 2018).*
FR Search Report, dated Feb. 4, 2015, from corresponding FR application.

* cited by examiner

*Primary Examiner* — George S Gray
(74) *Attorney, Agent, or Firm* — Young & Thompson

(57) ABSTRACT

An extendable drilling tool, the extendable tool moving in a drilling direction and including a body with a longitudinal axis and at least one arm that is mobile relative to the body in a direction of movement that forms a first angle with the longitudinal axis that is non-zero, less than 45°, and open upstream according to the direction of drilling. The extendable tool includes a piston that is mobile in a direction parallel to the longitudinal axis, the piston being located downstream according to the direction of drilling relative to the arm, the piston including at least one bearing surface that works with at least one arm and that forms with the longitudinal axis a second angle that is non-zero, less than 90°, and open downstream according to the direction of drilling.

12 Claims, 3 Drawing Sheets

EXTENDABLE DRILLING TOOL

FIELD OF THE INVENTION

This invention relates to an extendable drilling tool. More particularly, the invention relates to a tool that makes it possible to enlarge a borehole.

BACKGROUND OF THE INVENTION

During drilling of an oil well, gas well, or other well, a casing comprising several segments arranged end-to-end is put into place on the walls of the borehole. The various segments are installed as drilling proceeds, the segments at the drilling bottom having to pass through those already installed.

To maintain the largest possible passage section, the drilling device can comprise an enlargement tool that is generally positioned above a head tool that is designed to dig the bottom of the slot, such as a drill bit, for example.

In a known way, an enlargement tool comprises a body whose cross-section is less than the diameter of the casing and that has a circular shape along a longitudinal axis that is merged with the axis of the drilling device. This body comprises at an upper end a connection to an upper rod of the drilling device and at a lower end a connection to a lower rod of the drilling device. It also comprises a central pipe to allow the passage of a fluid in the direction of the head tool.

The enlargement tool also comprises several arms that are mobile relative to the body between a retracted position in which they do not protrude relative to the body and an extended position in which they protrude relative to the body so that the rotation of the enlargement tool along the longitudinal axis causes the enlargement of the borehole.

Several kinematic options can be envisioned for changing the positions of the arms. According to a first kinematic option, the arms pivot relative to an axis of rotation that is perpendicular to the longitudinal axis, as illustrated by way of example by the document U.S. Pat. No. 7,401,666.

According to a second kinematic option, the arms move translationally relative to the body in a direction that is perpendicular to the longitudinal axis or inclined relative to said axis. The invention relates more specifically to this kinematic option that is described in particular in the documents U.S. Pat. No. 6,615,933 and U.S. Pat. No. 6,732,817.

The document U.S. Pat. No. 6,615,933 describes a kinematic option with arms that move translationally perpendicularly to the longitudinal axis, whereas the document U.S. Pat. No. 6,732,817 describes a kinematic option with arms that move translationally in a direction that is inclined relative to the longitudinal axis.

As a supplement to the kinematic option, different types of actuators exist to cause the movement of the arms from the retracted position to the extended position.

The invention also relates more specifically to tools comprising a piston guided into the body so as to move translationally in a longitudinal direction (parallel to the longitudinal axis) and that comprises at least one bearing surface in contact with the arms.

SUMMARY OF THE INVENTION

According to a first embodiment adapted to the arms that move translationally in a direction that is inclined relative to the longitudinal axis, the bearing surface of the piston is perpendicular to the longitudinal axis, as illustrated in the document U.S. Pat. No. 6,732,817. According to this embodiment, the body comprises a slot for each arm, and each arm comprises two side walls that work with two side walls of the corresponding slot. To ensure the guiding of the translational movement, each side wall of the arm comprises several ribs that are accommodated in grooves provided in the area of the side wall of the corresponding slot.

The ribs and the grooves have profiles that work together in such a way that the arms can slide with a minimum play in the slots in a direction that includes a radial component (perpendicular to the longitudinal axis) and a longitudinal component (parallel to the longitudinal axis). To make this movement possible, the slots must have a length that is greater than that of the arms.

To deploy the arms in the extended position, the piston moves translationally upward and exerts a longitudinal force on the arms that is oriented upward. Because of this force, each arm moves translationally longitudinally upward and radially toward the outside of the body. To convert this longitudinal force into a movement comprising radial and longitudinal components, it is necessary to provide on both sides of each arm several ribs that work with several grooves, and/or it is necessary that the angle formed between the direction of the ribs and the longitudinal axis is relatively small.

The presence of all of these ribs and grooves complicates the tool. According to another drawback, the fact of providing a reduced angle between the grooves and the longitudinal axis leads, on the one hand, to increasing the travel of the piston, and, consequently, to lengthening the body of the enlargement tool, and on the other hand, to increasing the longitudinal travel of the arms and therefore to increasing the length of the slots and to providing more considerable space between each slot and each arm. This considerable space can enable the accumulation of elements external to the tool that can lock the arms in extended position.

According to a second embodiment adapted to the arms that move translationally in a direction perpendicular to the longitudinal axis, the bearing surface of the piston is inclined relative to the longitudinal axis, as illustrated in the document U.S. Pat. No. 6,615,933. According to this embodiment, the bearing surface of the piston forms, for each arm, a ramp that works with the rear face of the arm (the one oriented toward the central pipe). To cause the movement of each arm in a radial direction, the ramp must form a small angle with the longitudinal axis, and a part of the piston must always be inserted between the arm and the central pipe. The presence at all times of a part of the piston between the arms and the central pipe leads to reducing the radial size of the arms and consequently the diameter of the enlarged hole.

According to another drawback, the fact of providing a reduced angle between the ramp or ramps of the piston and the longitudinal axis leads to increasing the travel of the piston that tends to lengthen the body of the enlargement tool.

Consequently, regardless of the embodiment, the enlargement tool is relatively long and cannot easily be incorporated into a head tool.

To generate the movement of the arms from the extended position to the retracted position, an enlargement tool comprises a compression spring, as shown in the document U.S. Pat. No. 6,732,817. The presence of this compression spring leads to increasing the length of the enlargement tool. The document U.S. Pat. No. 6,615,933 proposes a solution that consists in using the lower edge of the casing to cause the retraction of the arms. For this solution to work, it is absolutely necessary that the piston move translationally downward to cause the extension of the arms and that the angle of the ramp of the piston with the longitudinal axis be open upward.

To cause the movement of the piston, an enlargement tool according to the document U.S. Pat. No. 6,732,817 uses the pressure of the fluid channeled by the central pipe. For this purpose, the enlargement tool comprises a system for managing the pressurized fluid so as to control the movement of the piston. This management system contributes to complicating the enlargement tool and increasing its length.

The document U.S. Pat. No. 6,615,933 proposes an alternative that consists in using the weight of the drilling device placed above the enlargement tool when the head tool is in contact with the bottom of the borehole.

According to this document, the enlargement tool comprises a body in two parts, an upper part connected to a rod of the drilling device that rises to the surface and a lower part connected to a rod of the drilling device that is connected to the head tool. The upper part slides inside the lower part and supports a piston whose end is oriented downward. In addition, the lower part comprises for each arm a slot whose cross-section is identical to that of the corresponding arm. When the head tool is in contact with the bottom of the well, the lower part of the enlargement tool is immobilized whereas the upper part continues to descend. Because of this relative movement between the upper and lower parts, the piston slides under the arms. Taking into account the geometry of the piston, the arms extend.

During drilling, it is necessary that the head tool exerts a considerable and constant force at the bottom of the hole to keep the arms separated in opposition to the cutting forces that tend to cause them to return to the retracted position. Now, the layers through which the head tool passes do not all have the same consistency so that the force of the head tool varies. Consequently, when the cutting tool drills a more brittle area, the arms have a tendency to return to a retracted position. To eliminate this problem, the enlargement tool described in the document U.S. Pat. No. 6,615,933 comprises a system for managing the pressurized fluid channeled by the central pipe to exert a force of pressure on the piston and to compensate for the variation of the force generated by the head tool. Consequently, even if the enlargement tool uses the weight of the drilling device to cause the extension of the arms, it is necessary to provide a system for managing the pressurized fluid channeled by the central pipe to keep the arms in extended position, which tends to complicate the enlargement tool and to increase its length.

Also, this invention aims to eliminate the drawbacks of the prior art by proposing an extendable tool that is compact and of simple design.

For this purpose, the invention has as its object an extendable drilling tool, said extendable tool moving in a drilling direction and comprising a body with a longitudinal axis and at least one arm that is mobile relative to the body in a direction of movement that forms a first angle with the longitudinal axis that is non-zero, less than 45°, and open upstream according to the direction of drilling, characterized in that the extendable tool comprises a piston that is mobile in a direction parallel to the longitudinal axis, said piston being located downstream according to the direction of drilling relative to the arm(s), said piston comprising at least one bearing surface that works with at least one arm and that forms with the longitudinal axis a second angle that is non-zero, less than 90°, and open downstream according to the direction of drilling.

This configuration makes it possible to obtain a more compact tool thanks to the combination of the two angles and makes it possible to simplify the guiding of the arms relative to the body. It also makes it possible to use a low edge of a casing to bring about the retraction of the arms. Thus, it is no longer necessary to provide a return spring to cause this movement that contributes to simplifying the tool and to improving its compactness.

Preferably, the body comprises a first connection suitable for connecting an upper segment of rods, and the piston is connected to a head tool. This configuration makes it possible not to need a system for managing fluid to cause the extension of the arms.

According to another characteristic, the body comprises for each arm a slot with two side walls, each one comprising a groove in which a rib slides that is provided at the level of each side face of each arm, said grooves being oriented in the direction of movement. Thus, according to the invention, the guiding of each arm relative to the body comprises only a single rib on each side wall of the arm that tends to simplify the design of the tool.

According to another characteristic, the body comprises for each arm a slot with an upstream wall at least a first portion of which is planar and oriented in a direction parallel to the direction of movement and that works with a planar upstream face of the arm that is accommodated in said slot. Preferably, the upstream face and the ribs of the arm are parallel. This configuration improves the guiding of the arms relative to the body.

According to another characteristic, the extendable tool comprises a central pipe, a first end of which is fitted into the body and a second end of which slides in the piston, and each arm comprises an inside surface oriented toward the central pipe and a bearing surface adjacent to the inside surface that works with the piston and that forms with the longitudinal axis an angle less than 90° that is open toward the piston. Preferably, the bearing surface of the arm is parallel to the bearing surface of the piston. This configuration contributes to improving the sturdiness of the arms because no part of the piston is inserted between the central pipe and the arm when the latter is in the retracted position.

According to another characteristic, the extendable tool comprises at least one locking mechanism to immobilize the piston in at least one downstream position corresponding to a retracted position of the arm or arms.

According to an embodiment, the piston comprises at least one channel, and the body comprises at least one channel that works with the channel of the piston when said piston is in the downstream position. In addition, the locking mechanism comprises an elastic ring configured to occupy a first state in which the elastic ring is placed astride in the channel of the piston and at least one channel of the body so as to immobilize in translation the piston relative to the body and a second state in which the elastic ring is accommodated only in the channel of the piston so as to make possible a translational movement of the piston relative to the body, the elastic ring having a tendency to be positioned in the first state because of its elasticity.

Preferably, the elastic ring comprises beveled edges and/or the channel or channels of the body have side walls inclined to facilitate the passage of the elastic ring from the first state to the second state.

According to another characteristic, each arm comprises an outside surface with, in a longitudinal plane, a central portion parallel to the longitudinal axis, a first portion adjacent to a face that is upstream and inclined toward the longitudinal axis and a second portion adjacent to a face that is downstream and inclined toward the longitudinal axis. In addition, the body comprises for each arm a slot that comprises in a longitudinal plane a narrow opening such that when the arm is in an extended position, the space between the arm and the slot is reduced.

BRIEF DESCRIPTION OF THE DRAWINGS

Other characteristics and advantages will emerge from the following description of the invention, a description given only by way of example, with regard to the accompanying drawings in which:

In FIGS. 2A and 2B, a borehole 10 has been shown with a bottom 12 that can be seen only in FIG. 2B.

Figure 2A:
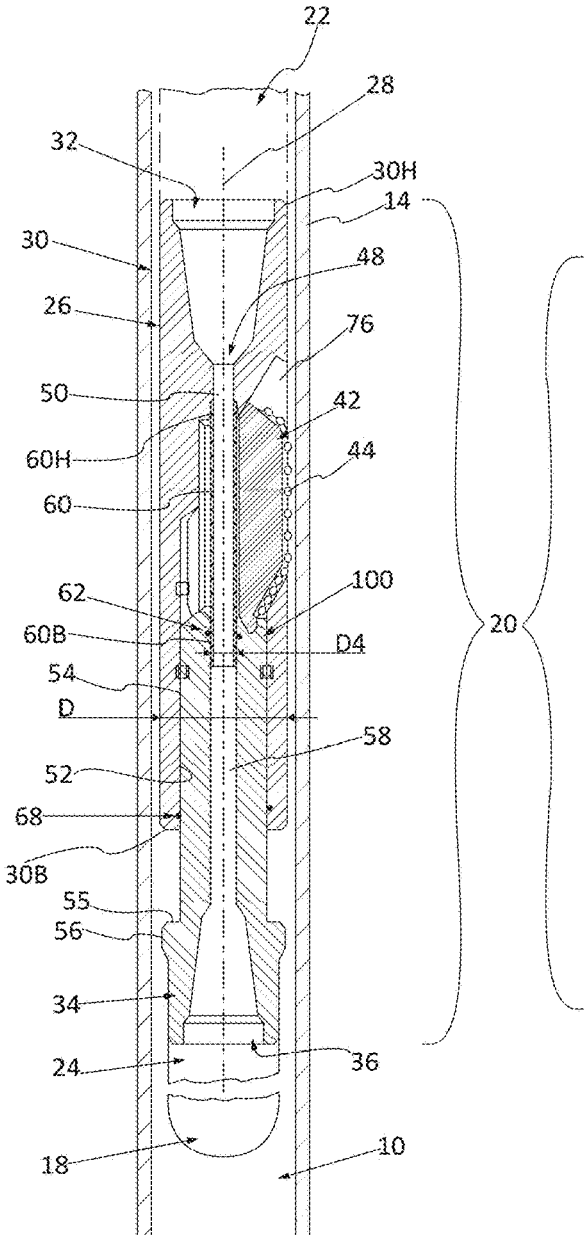
FIG. 2A is a longitudinal cutaway view of the enlargement tool that can be seen in FIG. 1 with arms in retracted position.
Figure 2B:
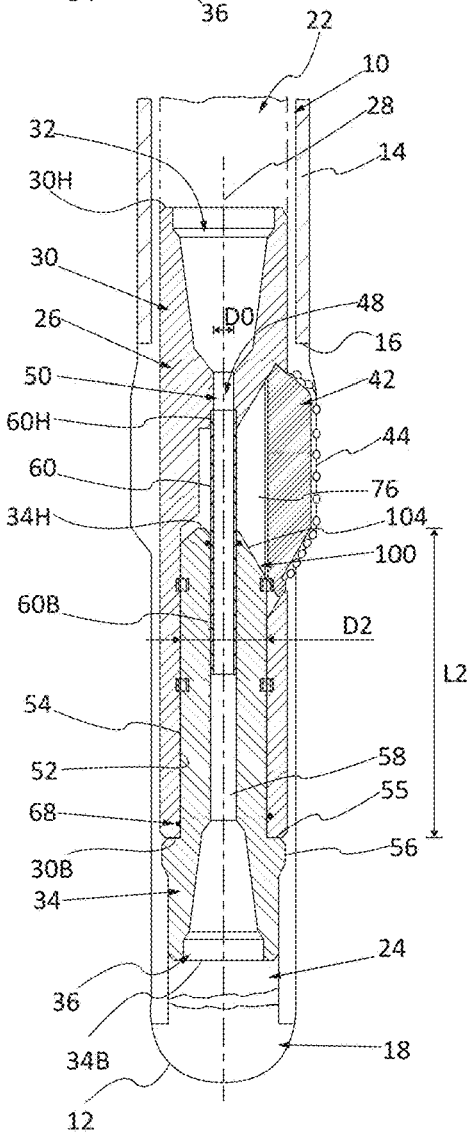
FIG. 2B is a longitudinal cutaway view of the enlargement tool that can be seen in FIG. 1 with arms in extended position.

This borehole 10 comprises a casing 14 with a lower edge 16 that can be seen in FIG. 2B.

DETAILED DESCRIPTION OF THE INVENTION

In FIGS. 2A, 2B, a drilling device has been shown that comprises a head tool 18, an extendable tool 20, an upper segment of rods 22 located above the extendable tool 20 that extends up to the surface, and a lower segment of rods 24 located under the extendable tool 20 and that connects to the head tool 18.

The head tool 18, the rod segments 22 and 24, as well as the other elements of the drilling device are not described further because they are known to a person skilled in the art.

The extendable tool 20 comprises a body 26 that has approximately a circular shape along a longitudinal axis 28.

The longitudinal axis is theoretically merged with the axis of the casing 14.

For the rest of the description, a longitudinal plane contains the longitudinal axis 28. A longitudinal direction is parallel to the longitudinal axis 28. A radial direction is secant and perpendicular to the longitudinal axis 28. A radial plane is a plane that is perpendicular to the longitudinal axis 28.

Figure 1:
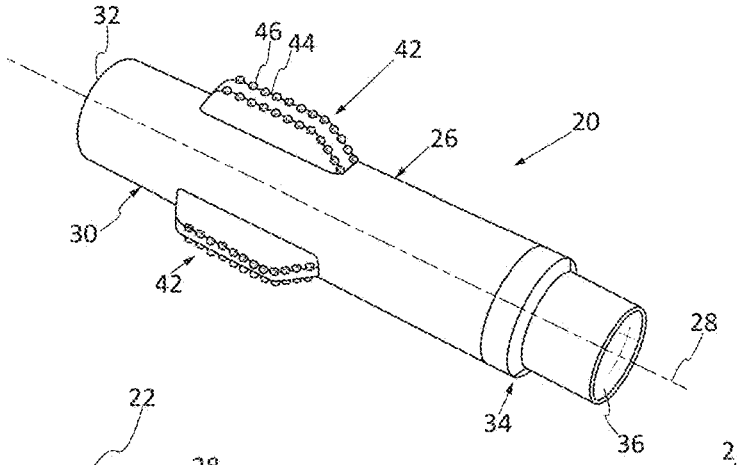
FIG. 1 is a view in perspective of an enlargement tool that illustrates a first variant of the invention.

According to a first variant illustrated in FIGS. 1, 2A, 2B, the body 26 comprises an upper part 30 that comprises a connection 32 with the upper segment of rods 22 and a lower part 34 that comprises a connection 36 with the lower segment of rods 24 or a head tool. The connections 32 and 36 are not described further because they are configured as a function of the connection systems provided at the ends of the segments of rods 22, 24.

Figure 3:
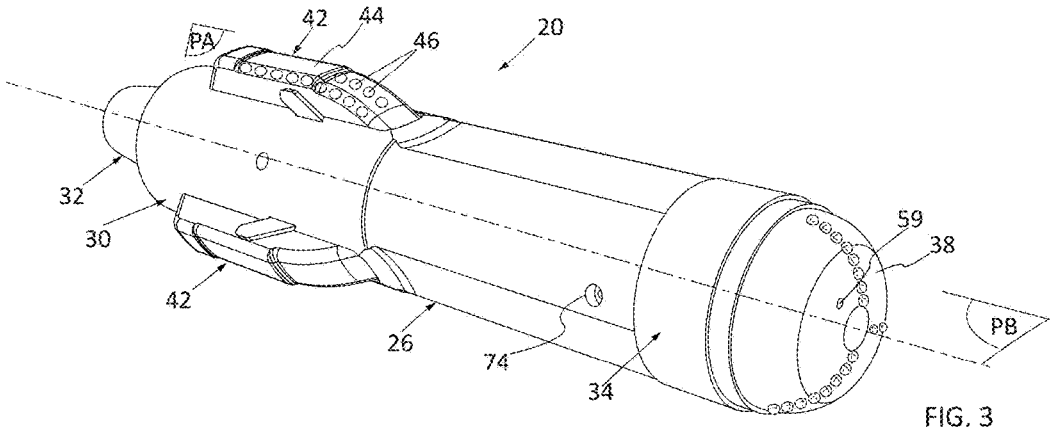
FIG. 3 is a view in perspective of a head tool that incorporates an enlargement tool that illustrates a second variant of the invention.
Figure 4A:
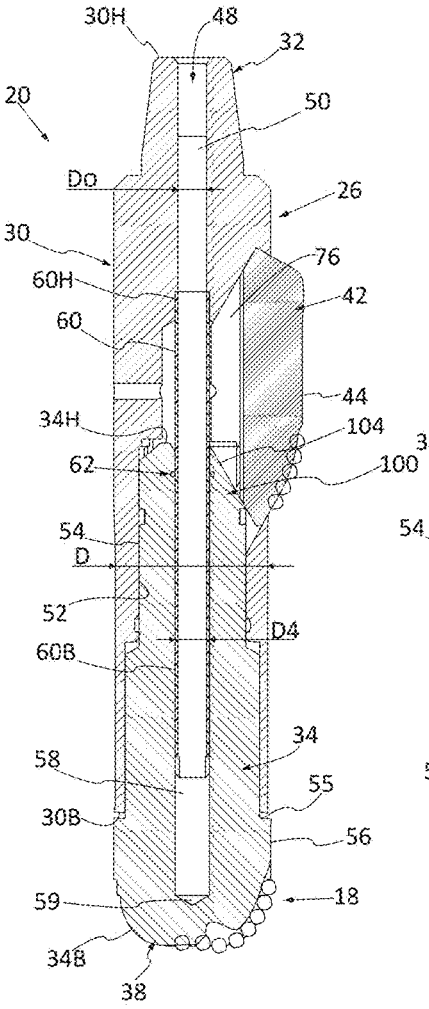
FIG. 4A is a longitudinal cutaway view along the plane PA of FIG. 3.
Figure 4B:
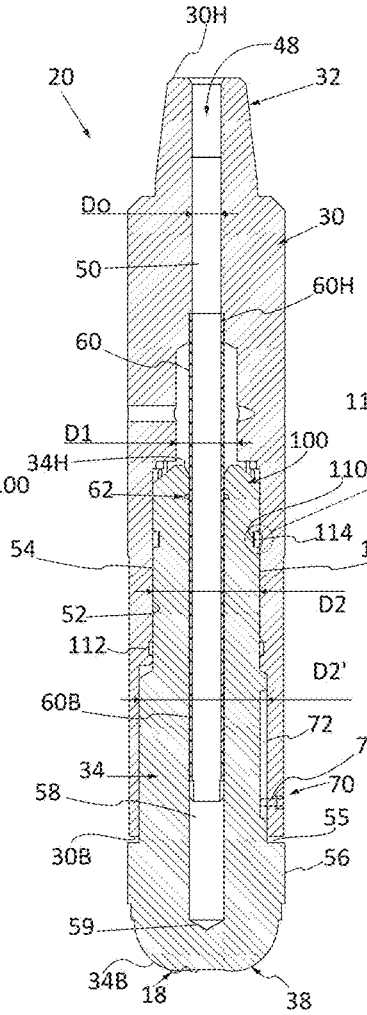
FIG. 4B is a longitudinal cutaway view along the plane PB of FIG. 3.

According to a second variant illustrated in FIGS. 3, 4A, 4B, the body 26 comprises an upper part 30 that comprises a connection 32 with the upper segment of rods 22 and a lower part 34 that comprises a head tool 18. Thus, according to this variant, the lower part 34 comprises a lower end 38 whose shape is consistent with that of a head tool and attached elements that make it possible for said lower end 38 to be able to drill in the manner of a conventional head tool.

According to this variant, the extendable tool 20 and the head tool 18 form only one single tool.

Figure 9A:
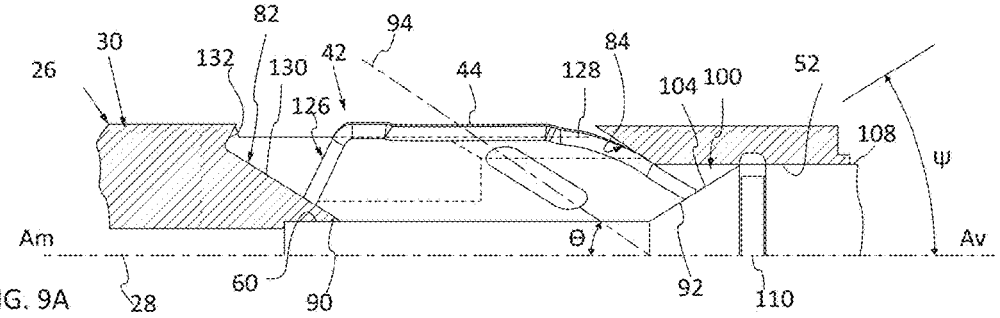
FIG. 9A is a longitudinal half-cutaway view that illustrates an arm in retracted position.

Regardless of the variant, the extendable tool 20 comprises at least one arm 42 that is mobile relative to the body 26 between a retracted position that can be seen in FIGS. 2A, 9A in which each arm 42 does not protrude relative to the body 26 and an extended position that can be seen in FIGS. 1, 2B, 3, 4A, 9B in which each arm 42 protrudes relative to the body 26.

Generally, the extendable tool 20 comprises several arms 42 that are distributed regularly on the circumference of the body 26. According to an embodiment illustrated in the various figures, the extendable tool 20 comprises three arms 42 positioned at 120° on the circumference of the body 26. However, the invention is not limited to this number of arms 42.

According to an application, each arm 42 comprises an outside surface 44 oriented toward the outside of the extendable tool 20 that comprises attached elements 46 and/or shapes suitable for digging the ground. In this case, the extendable tool 20 corresponds to an enlargement tool or underreamer.

According to another application, the surface 44 has different shapes that impart to the extendable tool 20 the function of stabilizer. In this case, the extendable tool 20 corresponds to an extendable stabilizer ("extendable stabilizer" in English).

The upper part 30 has a cylindrical shape with an outside diameter D and extends from a first end 30H to a second end 30B.

The upper part 30 comprises a pipe 48 that extends from the first end 30H to the second end 30B. This pipe comprises, from the first end 30H to the second end 30B, a connecting segment 50 with an inside diameter D0, an intermediate segment with a diameter D1 that is greater than or equal to D0, and a guiding segment 52 with a diameter greater than D0. Functionally, the intermediate segment is not necessary.

The diameter D0 is suitable for channeling a fluid. The end of the connecting segment 50 that comes out at the level of the first end 30H preferably has determined shapes to ensure a connection with the upper segment of rods 22.

The guiding segment 52 comprises at least one cylindrical bearing with a diameter D2 greater than D0 whose length L2 is sufficient to ensure an optimal guiding of the lower part 34 in a direction merged with the longitudinal axis 28.

The lower part 34 has a cylindrical shape and extends from a first end 34H to a second end 34B. The lower part 34 comprises at least one guiding segment whose diameter is approximately equal to the sliding clearance that is close to that of the guiding segment 52 of the upper part 30.

According to an embodiment illustrated in FIGS. 2A and 2B, the guiding segment 52 of the upper part 30 has one single diameter D2 on its entire length. In addition, the lower part 34 comprises a guiding segment 54 with a diameter equal to the sliding clearance that is close to the diameter D2 and an end segment 56 with a diameter approximately equal to the outside diameter D of the upper part 30.

According to an embodiment illustrated in FIGS. 4A and 4B, the guiding segment 52 of the upper part 30 comprises two stepped diameters D2 and D2'. In addition, the lower part 34 has a guiding segment 54 with two stepped diameters with respectively values equal to the sliding clearance that is close to D2 and D2' and an end segment 56 with a diameter approximately equal to the outside diameter D of the upper part 30.

The difference in diameter between the segments 54 and 56 forms a shoulder 55.

The lower part 34 also comprises a pipe 58 that extends from the first end 34H. In the case of the variant illustrated in FIGS. 2A and 2B, the pipe 58 extends from one end 34H to the other 34B.

In the case of the variant illustrated in FIGS. 4A and 4B, the pipe 58 separates in the vicinity of the second end 34B into several channels 59 that come out in the vicinity of the attached elements 46 of the head tool 18.

The extendable tool 20 comprises a central pipe 60 that makes it possible to channel a fluid between the upper and lower parts 30 and 34.

According to a configuration, the central pipe 60 has a first end 60H fitted into the body 26, more particularly into the connecting segment 50 of the upper part 30 and a second end 60B that slides into the pipe 58 of the lower part 34. This central pipe 60 has an inside diameter approximately equal to the diameter D0 of the connecting pipe 50 of the upper part 30 and an outside diameter D4 equal to the sliding clearance that is close to that of the pipe 58.

The guiding segments 52, 54, and the pipe 58 have lengths sufficient to make it possible for the upper part 30 and lower part 34 to move translationally in relation to one another between a deployed position that can be seen in FIG. 2A that corresponds to the retracted position of the arms 42 and a retracted position that can be seen in FIGS. 2B, 4A and 4B that corresponds to the extended position of the arms 42. In the retracted position, the second end 30B comes in contact against the shoulder 55 or is very close to the shoulder 55.

Preferably, the extendable tool 20 comprises sealing means 62 (that can be seen in FIGS. 4A and 4B) to ensure the sealing between the central pipe 60 and the lower part 34. According to an embodiment, the pipe 58 comprises a channel in which a seal in contact with the central pipe 60 is accommodated.

According to an embodiment, the extendable tool comprises sealing means 68 (that can be seen in FIGS. 2A and 2B) to ensure the sealing between the upper part 30 and lower part 34.

Advantageously, as illustrated in FIG. 4B, the extendable tool 20 comprises means 70 to prevent the rotation of the upper part 30 in relation to the lower part 34 (or vice versa) along the longitudinal axis 28. According to an embodiment, the lower part 34 comprises at the level of the guiding segment 54, in the vicinity of the shoulder 55, a longitudinal groove 72 in which a pin 74 that is integral with the upper part 34 can slide, the longitudinal groove 72 having a width equal to the sliding clearance that is close to the diameter of the pin 74. By way of example, the pin 74 is a bolt that is screwed into a radial threaded slot provided in the upper part, the bolt having a length such that its end is accommodated in the longitudinal groove 72.

The longitudinal groove 72 is long enough to make it possible for the upper part 30 and the lower part 34 to go from the deployed position to the retracted position or vice versa.

Figure 8:
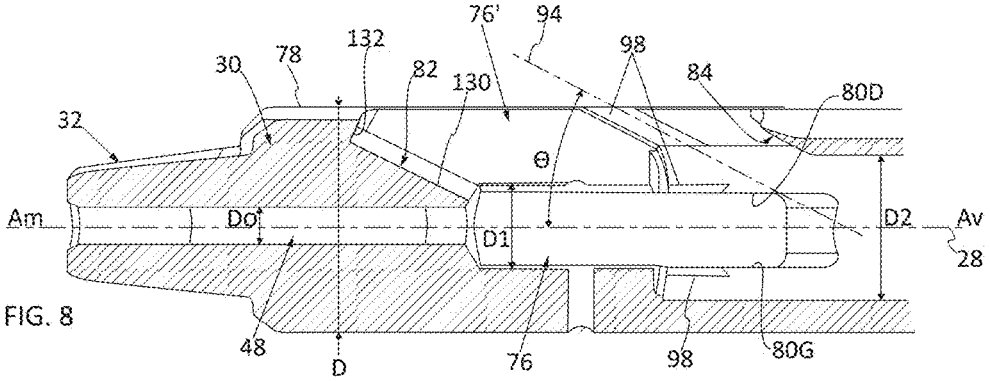
FIG. 8 is a longitudinal cutaway view of a part of a body of an enlargement tool that illustrates the invention.

The upper part 30 comprises for each arm 42 a slot 76 that causes the pipe 48 to communicate with the outside surface 78 of the upper part. In FIG. 8, a first slot 76, front view, and a second slot 76' in cutaway are shown.

For the rest of the description, upstream (Am) and downstream (Av) refer to the flow of the fluid inside the extendable tool 20 or to the direction of drilling, with an element located upstream being closer to the first end 30H of the upper part 30 of the body than a downstream element.

Figure 9B:
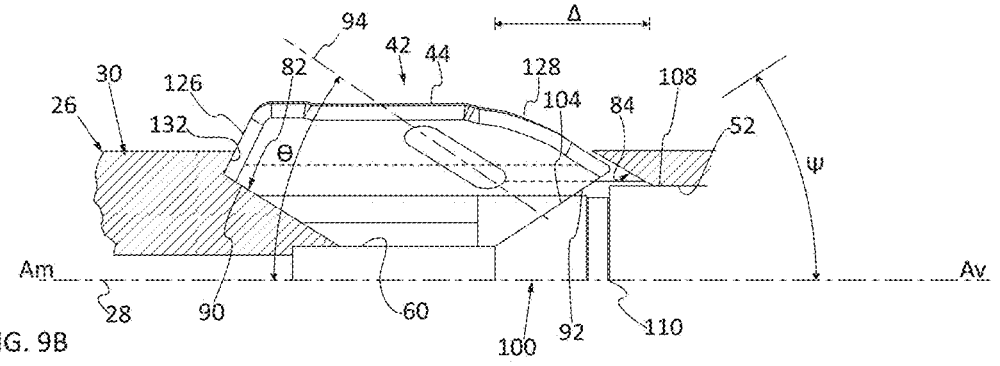
FIG. 9B is a longitudinal half-cutaway view that illustrates an arm in extended position.

As illustrated in FIGS. 8, 9A and 9B, each slot 76 comprises a right side wall 80D, a left side wall 80G, an upstream wall 82, and a downstream wall 84. According to one configuration, the right and left side walls 80D and 80G are parallel and positioned in planes parallel to the longitudinal axis 28, and the upstream and downstream walls 82 and 84 are positioned in planes secant to the longitudinal axis 28.

The downstream walls of the slots 76 are all separated by the same distance from the second end 30B of the upper part 30, and the upstream walls are all separated by the same distance from the first end 30H of the upper part 30. The slots 76 are positioned in the upper part 30 in such a way that the arms are in contact with the central pipe 60 in refracted position.

Concurrently, each arm 42 comprises an outside surface 44, an inside surface 86 closest to the longitudinal axis 28, oriented toward the central pipe 60, a right side face 88D that works with the right side wall 80D of the slot 76, a left side face 88G that works with the left side wall 80G of the slot, an upstream face 90 that works with the upstream wall 82 of the slot, and a downstream face 92.

According to a configuration, the right side face 88D and the left side face 88G are parallel.

Preferably, the inside face 86 has a shape that corresponds to a portion of a cylinder whose diameter is approximately equal to the outside diameter of the central pipe 60. In this way, the arms 42 work with the central pipe 60 in retracted position, which makes it possible to optimize their radial dimensions.

For each arm and slot pair, the side walls 80G and 80D of the slot have shapes that work with those of the side faces 88G and 88D of the arm so as to obtain a guiding in a direction of movement 94 of the arms, secant with the longitudinal axis 28 and making with the longitudinal axis an angle θ that is non-zero and less than 45° open upstream. Thus, during the changing from the extended position to the retracted position, the arms 42 have a movement comprising a component from upstream toward downstream. This configuration is preferred because it makes it possible to be able to use the lower edge 16 of the casing 14 to push the arms 42 into the retracted position.

According to an embodiment, each arm 42 comprises on each side face 88G and 88D a rib 96, oriented in the direction of movement 94, which works with a groove 98 made on each side wall 80G and 80D of the slot.

Each side face can comprise several ribs 96 that work with several grooves 98. However, the variant with a single rib 96 on each side face 80G and 80D is preferred because it makes it possible to simplify the design of the tool.

To cause the movement of the arms from the retracted position to the extended position, the extendable tool 20 comprises a piston 100 with an end 102 configured to work with each arm 42, said piston 100 being able to move translationally along the longitudinal axis 28 between a downstream position that can be seen in FIG. 2A that corresponds to the retracted position of the arms 42 and an upstream position that can be seen in FIGS. 2B and 4A that corresponds to the extended position of the arms 42.

For each arm, the piston 100 comprises at the level of the end 102 a bearing surface 104 that works with at least a portion of the downstream face 92 of the arm. Advantageously, the bearing surface 104 and the portion of the downstream face 92 that works with said bearing surface 104 are planar and flattened against one another. This configuration makes it possible to distribute the forces over a larger surface and to reduce the contact pressures. Preferably, the bearing surface 104 has a normal line that is secant with the longitudinal axis.

According to a characteristic of the invention, each bearing surface 104 forms with the longitudinal axis an angle ψ that is non-zero and less than 45° and opens in the opposite direction relative to the angle θ formed by the direction of movement 94 and the longitudinal axis 28.

Thus, in contrast with the pistons of the prior art with a bearing surface that is perpendicular to the longitudinal axis 28, the force exerted by the piston 100 on the arms comprises a radial component that facilitates the movement of the arms 42 in the direction of movement 94 that comprises a radial component.

With constant piston force, it is possible to increase the value of the angle θ of the direction of movement 94 that contributes to making the extendable tool more compact.

With a constant angle θ, it is possible to reduce the force exerted by the piston 100 on the arms 42 to cause their movements in extended position that contributes to reducing the stresses sustained by the piston 100 and/or the arms 42.

According to another advantage, the presence for each arm 42 of a bearing surface 104 that is not perpendicular to the longitudinal axis makes it possible to be able to guide the arm 42 by using a single rib 96 on each side face 88G and 88D. This configuration simplifies the design of the extendable tool, reduces the risks of jamming by limiting the sliding surfaces, and allows the use of greater clearances.

Advantageously, the angle θ of the direction of movement 94 of the arms is open upstream, the angle ψ of each bearing surface 104 of the piston 100 is open downstream, and the piston 100 is downstream from the arms 42. This configuration makes it possible to use the lower edge 16 of the casing 14 to cause the movement from the extended position to the retracted position of the arms 42. Thus, it is not necessary to provide a return means such as a compression spring to cause the movement of the arms 42 from the extended position to the retracted position. Therefore, this design makes it possible to make the extendable tool 20 more compact and more simple. Although it is not preferred, a variant with a return spring to cause the movement of the arms from the extended position to the retracted position is conceivable.

Advantageously, the angle θ has a value of between 30 and 45°. According to one embodiment, the angle θ is on the order of 30°.

Advantageously, the angle ψ is less than the angle θ. According to one embodiment, the angle ψ has a value on the order of 30°.

Preferably, for each arm and slot pair, the upstream wall 82 of the slot 76 comprises at least a planar portion oriented in a direction parallel to the direction of movement 94. The upstream face 90 of the arm is planar and parallel to the ribs 96 provided at the level of the side faces 88G and 88D.

As a variant, thanks to the guiding of the upstream face 90 of the arm relative to the upstream wall 82 of the slot in the direction of movement, it is possible to eliminate the ribs 96 and corresponding grooves 98.

Regardless of the variant, the extendable tool 20 comprises a piston 100 that comprises at least one bearing surface 104 that works with an arm 42 and that forms with the longitudinal axis an angle that is non-zero and less than 45° open in a first direction, and each arm 42 and slot 76 pair comprises at least a guiding parallel to a direction of movement 94 of the arm that forms an angle θ that is non-zero and less than 45° open in a second direction opposite that of the angle ψ.

Depending on the cases, the guiding function can be ensured by the ribs 96 that slide in the grooves 98 and/or by the upstream face 90 of the arm and/or the upstream wall 82 of the slot.

According to another characteristic, each arm 42 comprises a bearing surface adjacent to the inside surface 86 such as the downstream face 92 that works with the piston 100 and that forms with the longitudinal axis 28 an angle less than 90° open toward the piston 100. Preferably, the downstream face 92 is parallel to the bearing surface 104 of the piston. Thus, in retracted position, the inside surface 86 of each arm is in contact with the central pipe 60, and no part of the piston 100 is inserted between said central pipe 60 and each arm. According to this configuration, the arms have a maximum radial size that contributes to increasing the maximum enlargement diameter possible.

Figure 7:
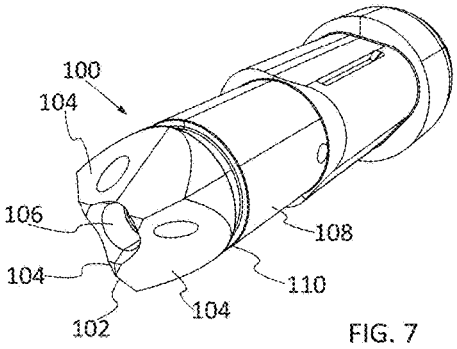
FIG. 7 is a view in perspective of a part of a piston of an enlargement tool that illustrates an embodiment of the invention.

According to an embodiment illustrated in FIG. 7, a piston 100 comprises three bearing surfaces 104, one for each arm, and a central hole 106 in which the central pipe 60 slides. Preferably, the sealing means 62 are inserted between the central hole 106 and the central pipe 60.

The piston 100 comprises a cylindrical bearing 108 that slides in the guiding segment 52 of the upper part 30.

According to a characteristic of the invention, the extendable tool 20 comprises at least one locking mechanism to immobilize the piston 100 at least in the downstream position. According to an embodiment illustrated in FIGS. 4B, 5A and 5B, the piston 100 comprises at the level of the cylindrical bearing 108 at least one channel 110 that extends over the entire circumference of the piston and that is positioned in a radial plane. In a longitudinal plane, the channel 110 has a bottom 110F and two side walls 110L, 110L' in radial planes.

In addition, the guiding segment 52 of the upper part 30 comprises at least a first channel 112 that is located in the same radial plane as the channel 110 of the piston when the latter is in downstream position. In a longitudinal plane, the channel 112 has a bottom and two side walls in planes that are radial and spaced apart.

According to a first variant, the guiding segment 52 of the upper part 30 comprises a single channel 112 to immobilize the piston 100 in the downstream position.

According to another variant, the guiding segment 52 of the upper part 30 comprises, in addition to the first channel 112, a second channel 114 that is located in the same radial plane as the channel 110 of the piston, when the latter is in the upstream position, to immobilize the piston 100 either in the downstream position, or in the upstream position.

In a longitudinal plane, the channel 114 has a bottom and two side walls in radial planes. The channels 112, 114 have a width that is approximately equal to that of the channel 110 of the piston.

The extendable tool 20 comprises an elastic split ring 116 that is accommodated at least partially in the channel 110 of the piston. As illustrated in detail in FIGS. 5A and 5B, this ring 116 has two side faces 118, 118' located in radial planes and an inside face 120I and an outside face 120E. This elastic ring 116 has a width (distance separating the two side faces) that is approximately equal to that of the channels 110, 112, 114.

Figure 5A:
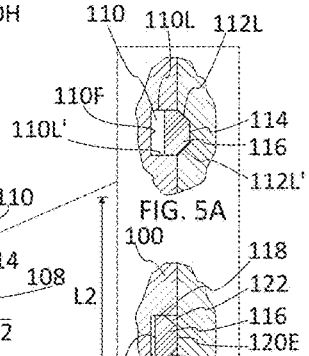
FIG. 5A is a detail of FIG. 4B that illustrates a locking mechanism in the locked state.
Figure 5B:
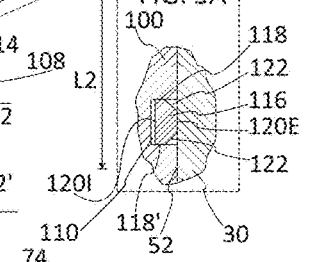
FIG. 5B is a cutaway view that illustrates the locking mechanism of FIG. 5A in the unlocked state.
Figure 6:
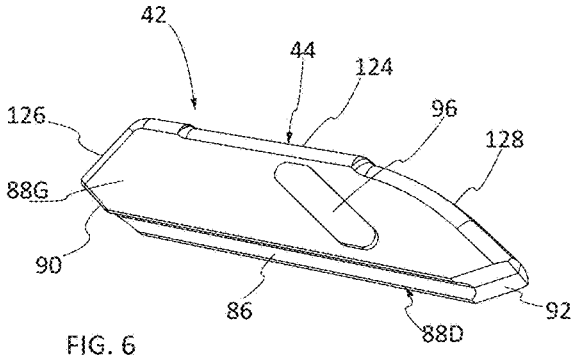
FIG. 6 is a view in perspective of an arm of an enlargement tool that illustrates an embodiment of the invention.

The elastic ring 116 occupies a resting state that can be seen in FIG. 5A in which it is located astride in the channel 110 of the piston and the channel 112 or one or the other of the channels 112 or 114 of the upper part 30 of the body and a retracted state that can be seen in FIG. 5B in which the elastic ring 116 is accommodated only in the channel 110 of the piston 100.

Because of its elasticity, the elastic ring 116 tends to position itself in the resting state. In this state, the piston 100 is immobilized in translation relative to the upper part 30 of the body. In the retracted state, the piston 100 can move translationally relative to the upper part 30 of the body.

For this purpose, the elastic ring 116 has a thickness less than the depth of the channel 110 of the piston 100 and greater than the depth of the channels 112, 114.

The passage from the resting state to the retracted state of the elastic ring 116 is caused when the piston 100 exerts on the body or vice versa a longitudinal force that is greater than a given threshold.

To do this, each channel 112, 114 has side walls 112L, 112L' that are inclined toward one another in such a way as to facilitate the retraction of the elastic ring 116 when the longitudinal force becomes greater than the given threshold.

In addition, the elastic ring 116 comprises beveled edges 122 at the level of the junction zones of the side walls 118, 118' and of the outside face 120E. Preferably, the beveled edges 122 are inclined in the same way as the side walls 112L, 112L'.

According to a variant, the extendable tool comprises a system for managing the fluid to cause the translational movement of the piston 100 in a first direction and a spring to cause the translational movement of the piston 100 in the opposite direction.

According to a preferred variant, the movement of the piston is caused because of the resting of the head tool 18 at the bottom of the borehole. In this case, the piston 100 is connected to a first connection of the extendable tool and/or to a head tool, and the body 26 is connected to a second connection of the extendable tool.

Preferably, the piston 100 is connected to the lower part 34. According to a preferred embodiment, the piston 100 and the lower part 34 form only one single part.

According to another characteristic that can be seen in FIGS. 6, 8, 9A and 9B, the outside surface 44 of each arm 42 comprises in a central part a central portion 124 that is approximately parallel to the longitudinal axis 28, a first portion 126 that is adjacent to the upstream face 90 and is inclined toward the longitudinal axis 28 and a second portion 128 that is adjacent to the downstream face 92 and is inclined toward the longitudinal axis 28.

Preferably, the first inclined portion 126 and the upstream face 90 form an angle that is close to 90°. This configuration improves the absorbing of the forces when the lower edge 16 of the casing is used to cause the movement of the arms 42 to the retracted position.

The portions 126 and 128 are inclined toward the longitudinal axis such that their ends that are adjacent to the upstream and downstream faces are closer to the longitudinal axis 28 than the central portion 124.

In addition, each slot 76 comprises, in a longitudinal plane, an opening that narrows. Thus, when the arms 42 are in extended position, they are in contact with—or very close to—the ends of the upstream wall 82 and the downstream wall 84. In this way, the space that remains between each arm 42 and its slot 76 is reduced, which limits the access to the outside elements and the risks of blocking the arms.

Advantageously, the upstream wall 82 comprises a first portion 130 that ensures the guiding of the upstream face 90 of the arm and a second portion 132 in contact or separated with a reduced clearance (on the order of a millimeter) with the first inclined portion 126 of the arm when the latter is in extended position, as illustrated in FIG. 9B. Thus, the portions 130 and 132 of the upstream wall 82 of the slot form an angle that is identical to the one formed by the first inclined portion 126 and the upstream face 90 of the arm.

According to one embodiment, the downstream wall 84 of the slot and the second inclined portion 128 of the arm 42 are parallel to the direction of movement 94. Thus, regardless of the position of the arm, the downstream wall 84 and the second inclined portion 128 are in contact or slightly spaced apart as illustrated in FIGS. 9A and 9B.

The invention claimed is:

1. An extendable drilling tool, comprising:

a body (26) with a longitudinal axis (28), said extendable drilling tool moving in a drilling direction, the body (26) including a first connection (32) that connects to an upper segment of rods;

at least one arm (42) that is mobile relative to the body (26) in a direction of movement (94) that forms a first angle (θ) with the longitudinal axis (28) that is non-zero, less than 45°, and open upstream according to the direction of drilling; and a piston (100) that is connected to a head tool (18) and is mobile in a direction parallel to the longitudinal axis (28), said piston (100) being located downstream according to the direction of drilling relative to the at least one arm (42), and said piston (100) comprising at least one bearing surface (104) that works with the at least one arm (42) and that forms, with the longitudinal axis (28), a second angle (ψ) that is non-zero, less than 90°, and open downstream according to the direction of drilling, wherein the body (26) further comprises, for each arm of the at least one arm (42), a first slot (76) with two side walls (80G, 80D), each one comprising a groove (98) in which a rib (96) slides, the ribs being provided at the level of each side face (88D, 88G) of each arm of the at least one arm (42), said grooves (98) being oriented in the direction of movement (94), and wherein the body (26) comprises, for each arm of the at least one arm (42), a second slot (76) with an upstream wall (82) at least a first portion (130) of which is planar and oriented in a direction parallel to the direction of movement (94) and that works with a planar upstream face (90) of the of the at least one arm (42) that is accommodated in said second slot (76).

2. The extendable tool according to claim 1, wherein the upstream face (90) and the ribs (96) of the at least one arm (42) are parallel.

3. The extendable tool according to claim 1, further comprising at least one locking mechanism to immobilize the piston (100) in at least one downstream position corresponding to a retracted position of the arm or arms (42).

4. The extendable tool according to claim 3, wherein the piston (100) comprises at least one channel (110), wherein the body (26) comprises at least one channel (112) that works with the channel (110) of the piston when said piston (100) is in the downstream position and wherein the locking mechanism comprises an elastic ring (116) configured to occupy a first state in which the elastic ring (116) is placed astride in the channel (110) of the piston and the channel (112) of the body so as to immobilize in translational movement the piston (100) relative to the body (26) and a second state in which the elastic ring (116) is accommodated only in the channel (110) of the piston (100) so as to make possible a translational movement of the piston (100) relative to the body (26), the elastic ring (116) having a tendency to be positioned in the first state because of its elasticity.

5. The extendable tool according to claim 4, wherein the elastic ring (116) comprises beveled edges (122) to facilitate the passage of the elastic ring (116) from the first state to the second state.

6. The extendable tool according to claim 4, wherein each channel (112, 114) of the body (26) has inclined side walls to facilitate the passage of the elastic ring (116) from the first state to the second state.

7. The extendable tool according to claim 1, wherein the extendable tool comprises a central pipe (60), a first end (60H) of which is fitted into the body (26) and a second end (60B) of which slides in the piston (100), and wherein each arm of the at least one arm (42) comprises an inside surface (86) oriented toward the central pipe (60) and a bearing surface (92) adjacent to the inside surface (86), the inside surface working with the piston (100) and that forms with the longitudinal axis (28) an angle less than 90° that is open toward the piston (100).

8. An extendable drilling tool, comprising:

a body (26) with a longitudinal axis (28), said extendable drilling tool moving in a drilling direction, the body (26) including a first connection (32) that connects to an upper segment of rods;

at least one arm (42) that is mobile relative to the body (26) in a direction of movement (94) that forms a first angle (θ) with the longitudinal axis (28) that is non-zero, less than 45°, and open upstream according to the direction of drilling; and a piston (100) that is connected to a head tool (18) and is mobile in a direction parallel to the longitudinal axis (28), said piston (100) being located downstream according to the direction of drilling relative to the at least one arm (42), and said piston (100) comprising at least one bearing surface (104) that works with the at least one arm (42) and that forms, with the longitudinal axis (28), a second angle (ψ) that is non-zero, less than 90°, and open downstream according to the direction of drilling wherein each arm of the at least one arm (42) comprises an outside surface (44) with, in a longitudinal plane, a central portion (124) parallel to the longitudinal axis (28), a first portion (126) adjacent to a face (90) that is upstream and inclined toward the longitudinal axis (28) and a second portion (128) adjacent to a face (92) that is downstream and inclined toward the longitudinal axis (28), and wherein the body comprises for each arm of the at least one arm, a slot (76) that comprises in a longitudinal plane an opening such that when the at least one arm is in an extended position, the slot closely receives the at least one arm, and wherein the slot (76) comprises an upstream wall (82) with two portions (130, 132) that form an angle that is identical to the one formed by the first portion (126) of the outside surface of the at least one arm (42) and of the upstream face (90).

9. An extendable drilling tool, comprising:

a body (26) with a longitudinal axis (28), said extendable drilling tool moving in a drilling direction, the body (26) including a first connection (32) that connects to an upper segment of rods;

at least one arm (42) that is mobile relative to the body (26) in a direction of movement (94) that forms a first angle (θ) with the longitudinal axis (28) that is non-zero, less than 45°, and open upstream according to the direction of drilling; and a piston (100) that is connected to a head tool (18) and is mobile in a direction parallel to the longitudinal axis (28), said piston (100) being located downstream according to the direction of drilling relative to the at least one arm (42), and said piston (100) comprising at least one bearing surface (104) that works with the at least one arm (42) and that forms, with the longitudinal axis (28), a second angle (ψ) that is non-zero, less than 90°, and open downstream according to the direction of drilling wherein each arm of the at least one arm (42) comprises an outside surface (44) with, in a longitudinal plane, a central portion (124) parallel to the longitudinal axis (28), a first portion (126) adjacent to a face (90) that is upstream and inclined toward the longitudinal axis (28) and a second portion (128) adjacent to a face (92) that is downstream and inclined toward the longitudinal axis (28), and wherein the body comprises for each arm of the at least one arm, a slot (76) that comprises in a longitudinal plane an opening such that when the at least one arm is in an extended position, the slot closely receives the at least one arm, and wherein the slot (76) comprises a downstream wall (84) parallel to the second portion (128) of the outside surface of the at least one arm (42).

10. An extendable drilling tool, comprising:

a body (26) with a longitudinal axis (28), said extendable tool moving in a drilling direction, said extendable tool further comprising at least one arm (42) that is mobile relative to the body (26) in a direction of movement (94) that forms a first angle (θ) with the longitudinal axis (28) that is non-zero, less than 45°, and open upstream according to the direction of drilling, wherein the extendable tool comprises a piston (100) that is mobile in a direction parallel to the longitudinal axis (28), said piston (100) being located downstream according to the direction of drilling relative to the at least one arm (42), said piston (100) comprising at least one bearing surface (104) that works with the at least one arm (42) and that forms with the longitudinal axis (28) a second angle (4) that is non-zero, less than 90°, and open downstream according to the direction of drilling, wherein the body (26) comprises, for each arm of the at least one arm (42), a slot (76) with an upstream wall (82) at least a first portion (130) of which is planar and oriented in a direction parallel to the direction of movement (94) and that works with a planar upstream face (90) of the of the at least one arm (42) that is accommodated in said second slot (76).

11. An extendable drilling tool, comprising:

a body (26) with a longitudinal axis (28), said extendable tool moving in a drilling direction, said extendable tool further comprising at least one arm (42) that is mobile relative to the body (26) in a direction of movement (94) that forms a first angle (θ) with the longitudinal axis (28) that is non-zero, less than 45°, and open upstream according to the direction of drilling, wherein the extendable tool comprises a piston (100) that is mobile in a direction parallel to the longitudinal axis (28), said piston (100) being located downstream according to the direction of drilling relative to the at least one arm (42), said piston (100) comprising at least one bearing surface (104) that works with the at least one arm (42) and that forms with the longitudinal axis (28) a second angle (ψ) that is non-zero, less than 90°, and open downstream according to the direction of drilling, and wherein the extendable tool comprises a central pipe (60), a first end (60H) of which is fitted into the body (26) and a second end (60B) of which slides in the piston (100), and wherein each arm of the at least one arm (42) comprises an inside surface (86) oriented toward the central pipe (60) and a bearing surface (92) adjacent to the inside surface (86), the inside surface working with the piston (100) and that forms with the longitudinal axis (28) an angle less than 90° that is open toward the piston (100).

12. The extendable tool according to claim 11, wherein the bearing surface (92) is parallel to the bearing surface (104) of the piston (100).

* * * * *